US010092917B2

(12) United States Patent
Zeeb

(10) Patent No.: US 10,092,917 B2
(45) Date of Patent: Oct. 9, 2018

(54) METHOD FOR PRODUCING A SPRAY JET, AND TWO-COMPONENT NOZZLE

(71) Applicant: Thomas Zeeb, Koengen (DE)

(72) Inventor: Thomas Zeeb, Koengen (DE)

(73) Assignee: LECHLER GMBH, Metzingen (DE)

( * ) Notice: Subject to any disclaimer, the term of this patent is extended or adjusted under 35 U.S.C. 154(b) by 0 days.

(21) Appl. No.: 14/992,470

(22) Filed: Jan. 11, 2016

(65) Prior Publication Data

US 2016/0199860 A1 Jul. 14, 2016

(30) Foreign Application Priority Data

Jan. 12, 2015 (DE) ..... 10 2015 200 236

(51) Int. Cl.

| | |
|---|---|
| ***B05B 7/02*** | (2006.01) |
| ***B05B 1/26*** | (2006.01) |
| ***B05B 7/08*** | (2006.01) |
| *B05B 7/04* | (2006.01) |

(52) U.S. Cl.

CPC ..... *B05B 7/02* (2013.01); *B05B 1/267* (2013.01); *B05B 7/0861* (2013.01); *B05B 7/0458* (2013.01)

(58) Field of Classification Search

CPC ... B05B 7/0416; B05B 7/0433; B05B 7/0441; B05B 7/002; B05B 1/267; B05B 7/0458; B05B 7/0861

USPC ..... 239/419, 419.3, 422–427, 428

See application file for complete search history.

(56) References Cited

U.S. PATENT DOCUMENTS

| | | | | |
|---|---|---|---|---|
| 1,451,063 | A | 4/1923 | Anthony | |
| 2,174,695 | A * | 10/1939 | Frickie | F23D 11/106 239/416 |
| 2,613,737 | A * | 10/1952 | Schwietert | F23D 11/103 239/419 |
| 5,170,941 | A | 12/1992 | Morita et al. | |
| 5,580,237 | A * | 12/1996 | Leger | C21C 5/4613 239/425 |
| 8,857,740 | B2 | 10/2014 | Wurz | |
| 8,955,470 | B2 | 2/2015 | Kudoh | |
| 2010/0163647 | A1 | 7/2010 | Wurz | |
| 2012/0222649 | A1 | 9/2012 | Kudoh | |

FOREIGN PATENT DOCUMENTS

| | | | |
|---|---|---|---|
| EP | 1 986 788 | B1 | 11/2008 |
| EP | 2 495 051 | A1 | 9/2012 |
| JP | 55-70366 | A | 5/1980 |
| JP | 2009-276030 | A | 11/2009 |
| KR | 10-2012-0087924 | A | 8/2012 |

(Continued)

OTHER PUBLICATIONS

European Patent Office Search Report issued in Application No. EP15200564 with English translation of the category of cited documents dated May 30, 2016 (7 pages).

(Continued)

*Primary Examiner* — Christopher Kim

(74) *Attorney, Agent, or Firm* — Flynn Thiel, P.C.

(57) ABSTRACT

A method for producing a spray jet from a liquid/gas mixture with a two-component nozzle having a nozzle housing, including the steps of blending a supplied liquid and a supplied gas and producing a spray jet consisting of gas and liquid drops, producing a gas jet and mixing of gas jet with the spray jet.

11 Claims, 3 Drawing Sheets

(56) References Cited

FOREIGN PATENT DOCUMENTS

WO WO 2007/080084 A1 7/2007

OTHER PUBLICATIONS

English Translation of Notice of Non-Final Rejection issued in Korean Appln. No. 10-2015-0174444 dated Aug. 28, 2017 (6 pages).
Office Action of China Patent Office issued in Application No. 201610017209.8 with English translation dated Oct. 26, 2017 (17 pages).

* cited by examiner

METHOD FOR PRODUCING A SPRAY JET, AND TWO-COMPONENT NOZZLE

CROSS-REFERENCE TO RELATED APPLICATION

This claims priority from German Application No. 10 2015 200 236.5, filed on Jan. 12, 2015, the disclosure of which is hereby incorporated by reference in its entirety into this application.

FIELD OF THE INVENTION

The invention relates to a method for producing a spray jet from a liquid/gas mixture with a two-component nozzle having a nozzle housing, with the steps of blending a supplied liquid and a supplied gas and producing a spray jet consisting of gas and liquid drops. The invention also relates to a two-component nozzle for spraying a liquid/gas mixture with a nozzle housing, wherein the nozzle housing has at least one liquid inlet, at least one gas inlet and at least one outlet opening, and wherein, during operation of the nozzle, a spray jet consisting of gas and liquid drops is present downstream of the at least one outlet opening.

BACKGROUND OF THE INVENTION

Two-component nozzles with an inner mixing chamber have a spray jet which has a core jet and an outer jet surrounding the core jet. The core jet and the outer jet can entirely merge together; as a rule, the core jet is distinct in the case of two-component nozzles. If such a spray jet enters a process surroundings, the drops in the core jet enter into the heat and substance exchange with the process surroundings only with a delay. As a result, evaporation distances are extended. Above all, it can be observed in the case of conventional two-component nozzles with an inner mixing chamber that large drops form in the core jet of the spray jet after exiting from the nozzle housing.

SUMMARY OF THE INVENTION

With the invention, a method for producing a spray jet and a two-component nozzle are intended to be improved in respect of avoiding large drops in the core jet of the spray jet.

In the case of a method according to the invention for producing a spray jet from a liquid/gas mixture with a two-component nozzle having a nozzle housing, with the steps of blending a supplied liquid and a supplied gas and producing a spray jet consisting of gas and liquid drops, the producing of at least one gas jet and mixing of the gas jet with the spray jet is provided.

Therefore, by a gas jet being mixed with the spray jet, the liquid drops present in the spray jet can be additionally atomised by the gas jet. As a result, the formation of large drops in the spray jet can be prevented.

In a development of the invention, the spray jet has a core jet and an outer jet surrounding the core jet, wherein the gas jet is first of all mixed with the core jet of the spray jet.

Since large drops may occur specifically in the core jet of the spray jet of a two-component nozzle, the mixing of the gas jet first of all with the core jet of the spray jet is particularly advantageous. This is because the gas jet then reliably provides further atomisation or division of the large drops in the core jet. Although the gas jet has already lost kinetic energy before passing into the region of the outer jet, this is non-critical, since the large drops located in the outer jet can be prevented, for example, by providing an annular nozzle surrounding the nozzle housing and therefore by using annular air.

In a development of the invention, the blending of the liquid and the gas within a mixing chamber of the nozzle housing and the mixing of the gas jet with the spray jet downstream of the mixing chamber are provided.

In a development of the invention, the mixing of the gas jet with the spray jet takes place within the nozzle housing.

Alternatively, the mixing of the gas jet with the spray jet can take place outside the nozzle housing.

The mixing of the gas jet can take place within or outside the nozzle housing depending on the existing space conditions and depending on the respectively applicable requirements regarding the drop size.

In a development of the invention, introducing the gas jet into a core jet of the spray jet in the form of a plurality of partial flows is provided, wherein the plurality of partial flows have a main movement component which is directed radially outwards with respect to a central longitudinal axis of the spray jet.

A division of the gas jet into a plurality of partial flows which are each directed radially outwards provides complete division of possible large drops in the core jet into finer drops.

In a development of the invention, the dividing of a gas, which is supplied to the two-component nozzle, within the nozzle housing into a first gas flow and a second gas flow is provided, wherein the first gas flow is provided for producing the spray jet, and the second gas flow is provided for producing the gas jet which is mixed with the spray jet.

The two-component nozzle therefore merely has to be supplied with gas of uniform pressure. The division into two gas flows then takes place within the nozzle housing.

In the case of a two-component nozzle according to the invention for spraying a liquid/gas mixture with a nozzle housing, the nozzle housing has at least one liquid inlet, at least one gas inlet and at least one outlet opening, and, during operation of the nozzle, a spray jet consisting of gas and liquid drops is present downstream of the at least one outlet opening. At least one further gas outlet opening is provided for producing a gas jet, wherein the further gas outlet opening is designed and arranged in a manner so as to mix the gas jet with the spray jet.

By provision of at least one further gas outlet opening, the gas jet can be mixed with the spray jet, and the production of large drops within the spray jet can be reliably prevented by the additional atomisation of the drops in the spray jet by means of the gas jet.

In a development of the invention, the nozzle housing has a mixing chamber, wherein the liquid inlet and the gas inlet lead into the mixing chamber, and wherein the at least one further gas outlet opening is arranged downstream of the mixing chamber and concentrically with respect to the mixing chamber.

By means of such an arrangement of the at least one further gas outlet opening, the gas jet can be mixed with the core jet of the spray jet.

In a development of the invention, the nozzle housing has an outlet opening for the spray jet, wherein the at least one further gas outlet opening is arranged downstream of the outlet opening.

In a development of the invention, the at least one further gas outlet opening is arranged upstream of the outlet opening.

Alternatively, the at least one further gas outlet opening is arranged downstream of the outlet opening.

Depending on the existing space conditions and the requirements regarding the drop size in the spray jet, the at least one further gas outlet opening can be arranged within the nozzle housing, i.e. upstream of the outlet opening, or outside the nozzle housing, i.e. downstream of the outlet opening.

In a development of the invention, the at least one further gas outlet opening is arranged in the region of the free end of a tube which is fastened to the nozzle housing concentrically with respect to the outlet opening.

By means of a simple tube arranged concentrically with respect to the outlet opening, the at least one further gas outlet opening can be realised in a simple manner and placed centrally with respect to the core jet.

In a development of the invention, the tube is provided at the free end thereof with a deflecting plate or a deflecting body and with a plurality of outflow openings directly upstream of the deflecting plate or the deflecting body.

In this way, it is possible to produce a plurality of gas jets which are directed with a main component radially outwards and can then bring about atomisation of large drops within the spray jet. A cone expanding in the flow direction can be used, for example, as a deflecting body. The direction of the emerging gas jets can be varied via the cone angle.

In a development of the invention, a plurality of outflow openings open radially outwards with respect to a central longitudinal axis of the tube.

As a result, the plurality of gas jets first of all obtain a radially outwardly directed movement, but are carried along by the spray jet during operation of the two-component nozzle, wherein the main component of the gas jets still remains directed radially outwards.

In a development of the invention, an annular gap surrounding the outlet opening is provided.

By means of an annular gap, the spray jet can still be shielded in relation to the process surroundings immediately after exiting from the outlet opening if enveloping air exits from the annular gap. However, the annular gap can also be used, for example, to prevent the formation of drops in a region surrounding the outlet opening.

BRIEF DESCRIPTION OF THE DRAWINGS

Further features and advantages of the invention emerge from the claims and the description below in conjunction with the drawings. Individual features of the various embodiments explained in the description with reference to the drawings can be combined with one another in any manner without exceeding the scope of the invention. In the drawings:

DETAILED DESCRIPTION

Figure 1:
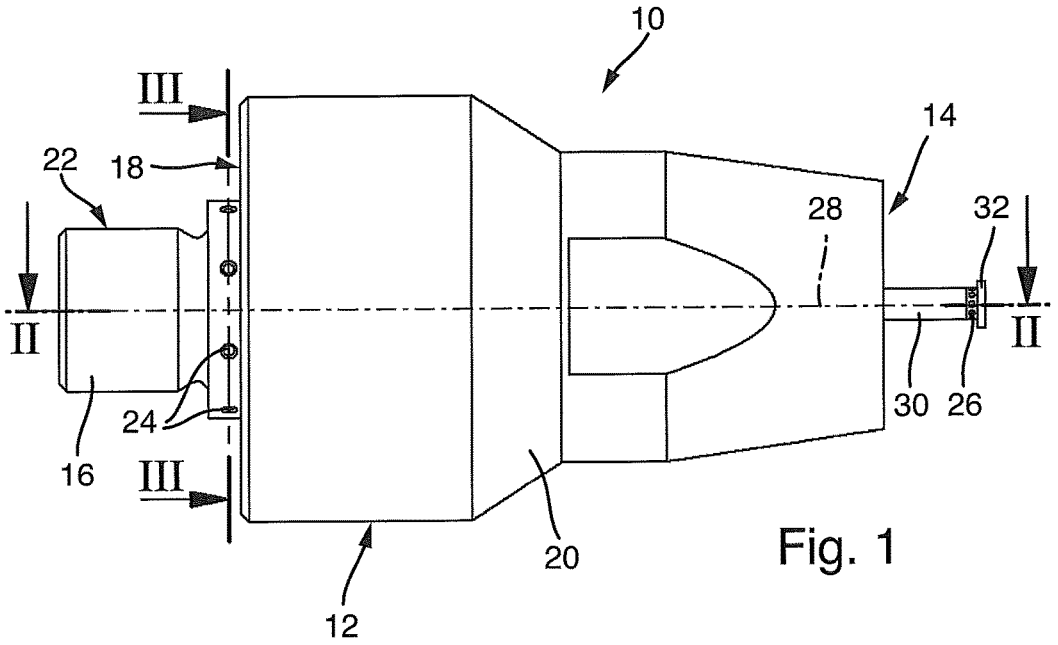
FIG. 1 shows a side view of a two-component nozzle according to the invention.

The illustration of FIG. 1 shows a two-component nozzle 10 according to the invention with a nozzle housing 12. The nozzle housing 12 has an outlet opening 14 from which a spray jet of liquid drops and gas emerges during operation of the two-component nozzle 10. Liquid to be atomised is supplied to the two-component nozzle 10 via a liquid inlet 16, wherein the liquid is conducted downstream of the liquid inlet 16 into a mixing chamber and atomised there. The liquid inlet 16 is provided with an external thread for the connection of a liquid supply line.

The liquid inlet 16 is provided with an annular gas inlet 18 through which gas, for example compressed air or water vapour, is supplied to the nozzle housing 12. The nozzle housing is provided with an internal thread on the outer wall of the gas inlet in order to be able to connect a gas supply line.

The nozzle housing 12 is of two-part design and has an outer shell 20 and an insert 22. The insert 22, at the left end thereof in FIG. 1, has the liquid inlet 16 and is inserted into the outer shell 20. The annular gas inlet 18 is formed between the insert 22 and the outer shell 20.

As can be seen in FIG. 1, immediately before the beginning of the outer shell 20, the insert 22 is provided with a total of eight gas channels 24 which are directed radially inwards. A gas flow is branched off by means of the gas channels 24, the gas flow then exiting again from a plurality of outflow openings 26 downstream of the outlet opening 14 and forming a plurality of gas jets which then mix with the spray jet emerging from the outlet opening 14. For this purpose, the gas channels 24 lead into a tube 30 which is arranged concentrically with respect to a central longitudinal axis 28 and at the free end of which a deflecting plate 32 is arranged. The plurality of outflow openings 26 are arranged directly upstream of the deflecting plate 32.

Figure 2:
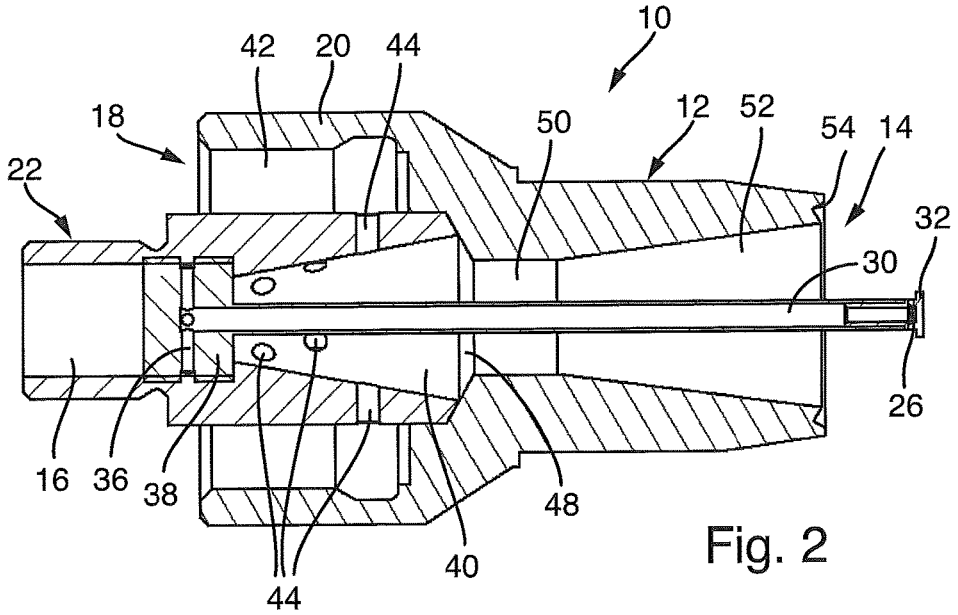
FIG. 2 shows a sectional view of the plane II-II in FIG. 1.

The illustration of FIG. 2 shows a view of the section plane II-II in FIG. 1. The two-part construction of the nozzle housing 12 from the outer shell 20 and the insert 22 inserted into the outer shell 20 can be seen. The annular gas inlet 18 and the liquid inlet 16 can readily be seen. The gas channels 24 lie outside the section plane II-II, and therefore they cannot be seen in the view of FIG. 2. However, the gas channels 24 lead into an annular channel 36 which is provided in a stopper 38 which, in turn, is screwed into the insert 22 concentrically with respect to the central longitudinal axis. From the annular channel 36, the gas flow branched off by means of the gas channels 24 passes into the interior space of the tube 30 and thereby passes to the outflow openings 26 at the free end of the tube 30. As has already been explained, a substantially radially directed gas jet emerges from each of the outflow openings 26 at the end of the tube 30. During operation of the two-component nozzle 10, said plurality of gas jets then cross the spray jet which emerges from the outlet opening 14.

During operation of the nozzle, the spray jet is produced by blending gas and liquid in a mixing chamber 40, through which the tube 30 passes. The gas inlet 18 leads into an annular space 42 from which a plurality of gas inlets 44 lead into the mixing chamber. The gas inlets lead radially into the mixing chamber 40, which has a shape widening in a circular-conical-shaped manner. As a result, gas flows emerging from the gas inlets 44 are directed radially inwards and substantially at right angles cross a liquid flow entering the mixing chamber 40.

The stopper 38 is provided with a plurality of liquid inlets 46 which are arranged concentrically around the tube 30. This can be seen in the view of FIG. 3 which shows a view of the section plane in FIG. 1.

From the total of eight liquid inlets 46, a respective liquid flow therefore enters the mixing chamber 40 parallel to the longitudinal axis 28. Gas flows from the gas inlets 44 impinge on the plurality of liquid flows at right angles and produce a gas/drop mixture within the mixing chamber 40. The mixing chamber is tapered at the end thereof located downstream, wherein said tapering is brought about by a circular-conical-shaped section 48. The circular-conical-shaped section 48 is substantially shorter than the mixing chamber 40. In the embodiment illustrated, the length of the tapering 48 is less than one tenth of the length of the mixing chamber 40. The tapering 48 is adjoined by a cylindrical section 50 which forms a narrowest cross section within the nozzle housing 12. The length of the cylindrical section 50 is approximately one third of the length of the mixing chamber 40. The cylindrical section 50 is adjoined by a section or exit chamber 52 which widens conically and ends at the outlet opening 14. The length of the section 52 is approximately three to four times the length of the cylindrical section 50 and, in the embodiment illustrated, corresponds approximately to the length of the mixing chamber 40.

The outlet opening 14 is surrounded by a groove 54 which is triangular in cross section and is intended to prevent drops from adhering to the housing 12 in the region surrounding the outlet opening 14.

Figure 3:
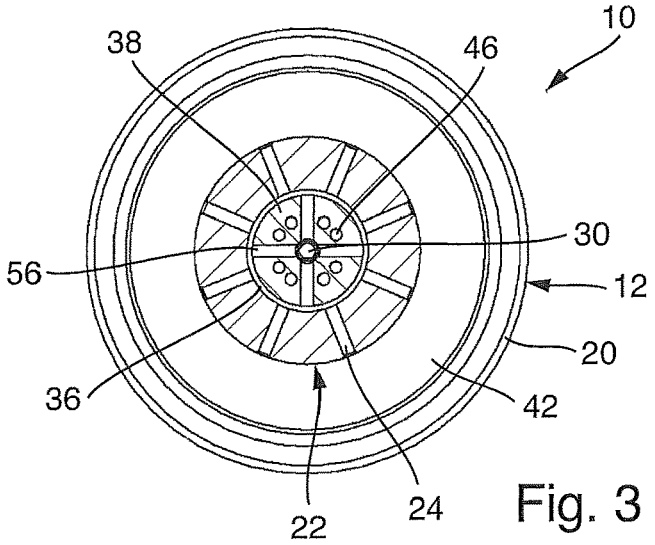
FIG. 3 shows a sectional view of the plane in FIG. 1.

In the illustration of FIG. 3, the annular space 42 between the insert 22 and the outer shell 20 of the nozzle housing 12 can be seen. Gas is introduced into said annular space 42. As has been explained, a gas flow is branched off from said annular space 42 by means of the total of eight gas channels 24 which are provided in the insert 22 and extend radially inwards. The gas channels 24 lead into the annular channel 36 which is formed in the stopper 38. The stopper 38 is inserted, see FIG. 2, into the insert 22. Starting from the annular channel 36, four further gas channels 56 are provided in the stopper 38, said gas channels being directed radially inwards and leading into the interior space of the tube 30. Gas therefore passes from the annular space 42 through the gas channels 24, into the annular channel 36, into the gas channels 56 and into the interior space of the tube 30. As has already been explained, the gas then emerges substantially radially at the free end of the tube 30 through the plurality of outflow openings 26.

As has been explained, a gas/liquid drop mixture is produced within the mixing chamber 40 and then passes through the cylindrical section 50 and the conical widening 52 as far as the outlet opening 14 and emerges there as a spray jet. The spray jet of the two-component nozzle 10 has a core jet and an outer jet surrounding the core jet. Large drops may occur here in the core jet of the spray jet; above all, it is possible for large drops again to form in the core jet of the spray jet after emerging from the outlet opening 14. Such large drops in the core jet of the spray jet are split again into smaller drops by the gas jets which emerge substantially radially outwards from the outflow openings 26. The gas jets emerging from the outlet openings 26 therefore cross the spray jet in order to prevent the formation of large drops within the spray jet or to reverse the formation thereof. Owing to the arrangement of the tube 30 on the central longitudinal axis of the two-component nozzle 10, the gas jets emerging from the outflow openings 26 first of all cross the core jet of the spray jet and subsequently the outer jet thereof.

Figure 4:
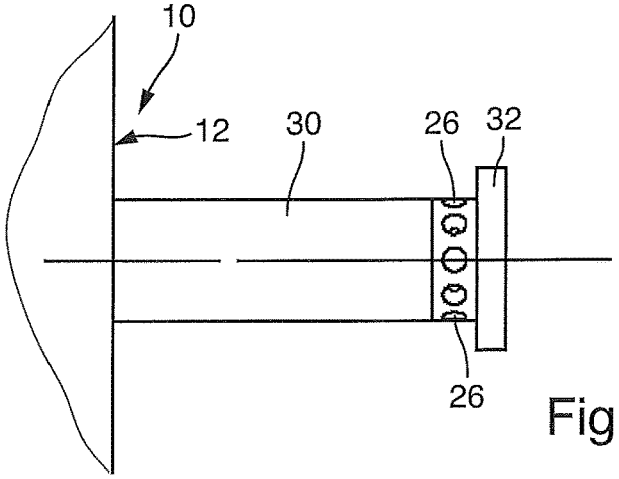
FIG. 4 shows the enlarged view of a detail of the two-component nozzle of FIG. 1.

The illustration of FIG. 4 shows an enlarged detail of the two-component nozzle 10 of FIG. 1. Specifically, the free end of the tube 30 with the deflecting plate 32 and the plurality of radially outwardly directed outflow openings 26 is illustrated in detail. The deflecting plate 32 is provided, see FIG. 2, with an extension which is pushed into the free end of the tube 30 and is anchored there. The outflow openings 26 are also provided on said insert. The tube 30 can therefore be constructed in a very simple manner structurally. The insert is pushed into the free end of the tube, as a result of which the deflecting plate 32 and the outflow openings 26 are placed on the free end of the tube 30.

Figure 5:
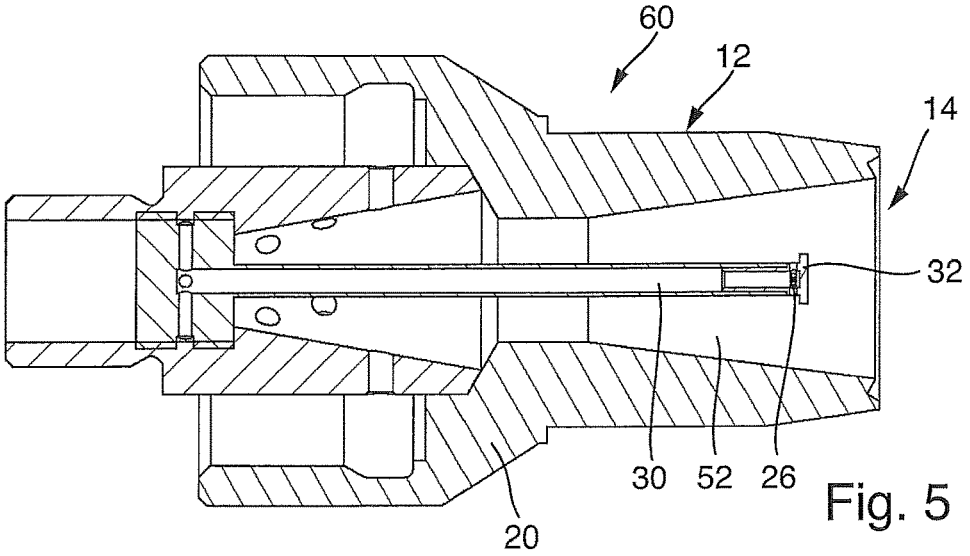
FIG. 5 shows a sectional view of a two-component nozzle according to the invention in accordance with a second embodiment of the invention.

The illustration of FIG. 5 shows a two-component nozzle 60 according to a second embodiment of the invention. The two-component nozzle 60 differs from the two-component nozzle 10 of FIG. 1 only in that the free end of the tube 30 with the deflecting plate 32 and the outflow openings 26 is arranged upstream of the outlet opening 14. The free end of the tube 30 and the outflow openings 26 are therefore still arranged within the outer shell 20 of the nozzle housing 12. The gas jets emerging from the outflow openings 26 therefore cross the spray jet, which is present in the conically widening section 52 of the nozzle housing 12, still within the nozzle housing 12.

Otherwise, however, the two-component nozzle 60 is constructed identically to the two-component nozzle 10 of FIG. 1. The individual components and the manner of operation of the two-component nozzle 60 are therefore not explained again.

Figure 6:
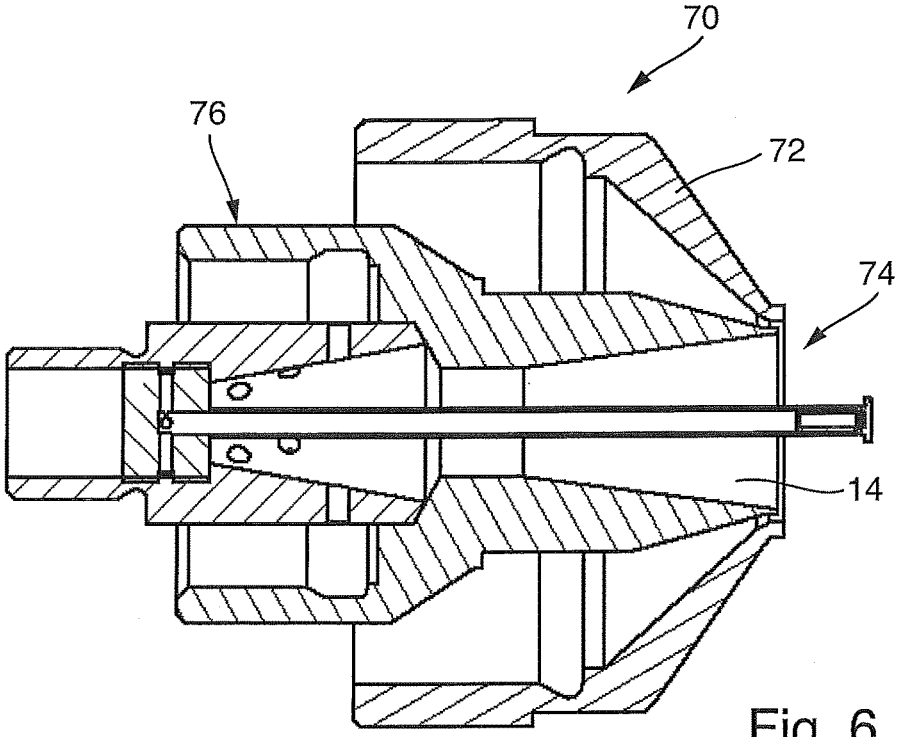
FIG. 6 shows a sectional view of a two-component nozzle according to the invention in accordance with a third embodiment.

The illustration of FIG. 6 shows a sectional view of a two-component nozzle 70 according to a third embodiment of the invention. The two-component nozzle 70 differs from the two-component nozzle 10 of FIG. 1 only by the presence of an annular gap cap 72 which, with the nozzle housing 76, forms an annular gap 74 surrounding the outlet opening 14. The annular gap 74 is fed with enveloping air. The spray jet emerging from the outlet opening 14 can thereby be shielded directly downstream of the outlet opening 14 in relation to process surroundings. Furthermore, it is also possible by means of enveloping air emerging from the annular gap 74 to atomise drops forming on that region of the nozzle housing 76 which surrounds the outlet opening 14 into fine drops. The nozzle housing 76 is formed with significantly thinner walls in the region thereof surrounding the outlet opening 14 than the nozzle housing 12 of the two-component nozzle 10. The annular gap cap 72 extends for a distance, as seen in the flow direction, beyond the end of the nozzle housing 76. As a result, the atomising of drops which accumulate on the nozzle housing 12 in the region surrounding the outlet opening 14 is facilitated and the outer edge of the nozzle housing 76 is protected against mechanical damage.

Otherwise, the two-component nozzle 70 is formed identically to the two-component nozzle 10 of FIG. 1, and the individual components of the two-component nozzle 10 and the function thereof are not explained again.

Figure 7:
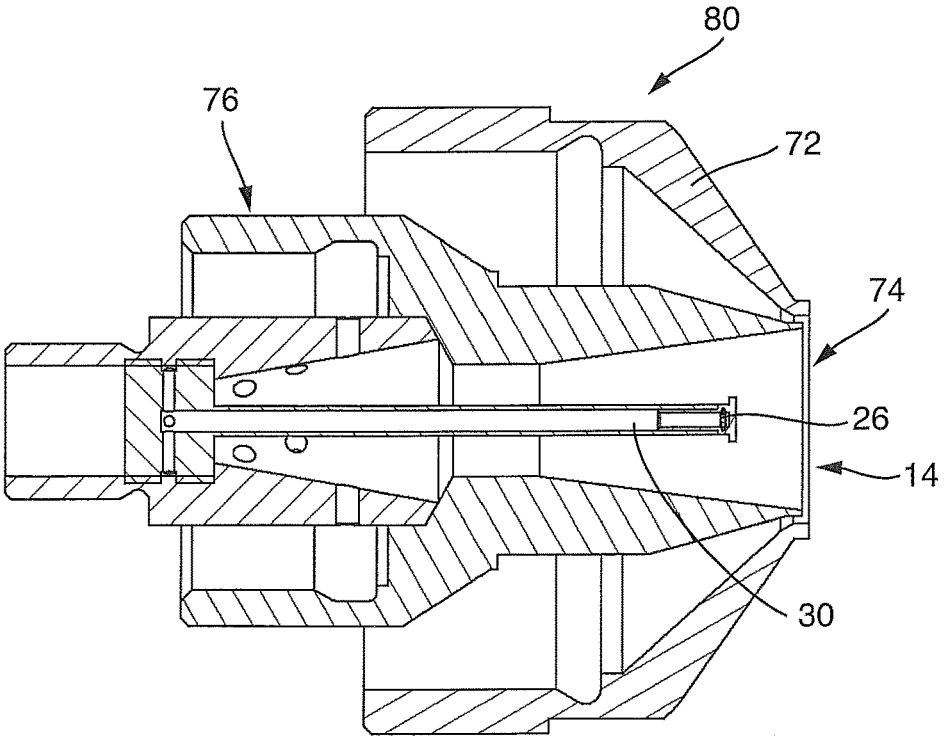
FIG. 7 shows a sectional view of a two-component nozzle according to the invention in accordance with a fourth embodiment of the invention.

FIG. 7 shows a two-component nozzle 80 according to the invention in accordance with a fourth embodiment of the invention. In contrast to the two-component nozzle 70 of FIG. 6, the free end of the tube 30 is arranged within the nozzle housing 76. The gas jets emerging from the outflow openings 26 at the free end of the tube 30 therefore cross the spray jet still within the nozzle housing 76, as has already been explained with reference to the two-component nozzle 60 of FIG. 5. Also in the case of the two-component nozzle 80, the provision of the annular gap 74 between the annular gap cap 72 and the nozzle housing 76 ensures that liquid drops accumulating in that region of the nozzle housing 76 which surrounds the outlet opening 14 can be split and therefore atomised into small drops. Otherwise, the individual components and the function of the two-component nozzle 80 are identical to the two-component nozzle 10 of FIG. 1 and are therefore not explained again.

The invention claimed is:

1. A two-component nozzle for spraying a liquid/gas mixture, said nozzle comprising:

a nozzle housing comprising a liquid inlet, a gas inlet, an outlet opening in communication with the liquid inlet and the gas inlet and through which outlet opening a spray jet including both liquid and gas drops exits the nozzle;

a tube disposed within the nozzle housing and arranged concentrically with respect to a central longitudinal axis of the outlet opening, the tube having a free end and including a plurality of gas outlet openings disposed around the central longitudinal axis and opening radially outwardly with respect thereto, the plurality of gas outlet openings being disposed to communicate directly with the spray jet exiting the outlet opening such that gas from the plurality of gas outlet openings is mixed with the liquid and gas drops of the spray jet immediately upon exit of the gas from the plurality of gas outlet openings;

a deflecting body disposed on the free end of the tube, the plurality of gas outlet openings being disposed upstream, with respect to a flow direction through the nozzle, of the deflecting body; and an exit chamber disposed downstream of the liquid inlet and gas inlet, the outlet opening being disposed at a downstream end of the exit chamber and liquid and gas drops from the exit chamber exit the nozzle through the outlet opening;

wherein the exit chamber has a conical configuration which enlarges radially in an upstream to downstream flow direction through the nozzle.

2. The nozzle of claim 1, wherein the nozzle housing includes a mixing chamber disposed within an interior thereof, the liquid inlet and the gas inlet opening into the mixing chamber and communicating therewith, and the plurality of gas outlet openings are disposed downstream of the mixing chamber.

3. The nozzle of claim 2, further including a cap disposed in surrounding relation with a downstream end of the nozzle housing, the cap and the downstream end of the nozzle housing together defining an annular gap through which air is dispersed.

4. The nozzle of claim 1, wherein the plurality of gas outlet openings are disposed upstream, with respect to a flow direction through the nozzle, of the outlet opening.

5. The nozzle of claim 1, wherein the plurality of gas outlet openings are disposed downstream, with respect to a flow direction through the nozzle, of the outlet opening.

6. The nozzle of claim 1, wherein the nozzle housing includes a mixing chamber disposed within an interior thereof and in communication with the liquid inlet and the gas inlet for mixing together liquid and gas received therefrom, and the exit chamber is in communication with the mixing chamber and disposed downstream of the mixing chamber.

7. The nozzle of claim 6, wherein the exit chamber defines a central longitudinal axis coextensive with the central longitudinal axis of the outlet opening, and the tube is disposed concentrically within the exit chamber such that liquid and gas drops within the exit chamber are disposed within an annular area of the exit chamber defined between an exterior of the tube and an inner wall of the nozzle housing which defines the exit chamber.

8. The nozzle of claim 7, wherein the plurality of gas outlet openings of the tube are disposed to issue gas radially into the annular area of the exit chamber adjacent the central longitudinal axis thereof.

9. The nozzle of claim 7, wherein the plurality of gas outlet openings of the tube are disposed axially downstream of the outlet opening and are configured to discharge gas radially into the liquid and gas drops of the spray jet exiting the outlet opening.

10. The nozzle of claim 6, wherein the mixing chamber has a conical configuration which enlarges radially in the upstream to downstream flow direction through the nozzle.

11. The nozzle of claim 6, wherein the nozzle housing includes an outer substantially tubular shell and an insert disposed substantially concentrically within the shell, the insert being spaced from an inner wall of the shell such that an annular space is defined between the inner wall and an exterior surface of the insert, the gas inlet opening into the annular space, the insert defining the mixing chamber therein and having an upstream end which defines the liquid inlet, the insert defining a first plurality of gas channels in communication with both the annular space and the plurality of gas outlet openings of the tube, the insert further including a second plurality of gas channels in communication with both the annular space and the mixing chamber.

* * * * *